US005473221A

United States Patent [19]

Do et al.

[11] Patent Number: 5,473,221

[45] Date of Patent: Dec. 5, 1995

[54] BUCKING FIELD SYSTEM AND METHOD FOR MITIGATING THE EFFECTS OF AN EXTERNAL MAGNETIC FIELD ON A CATHODE RAY TUBE DISPLAY

[75] Inventors: Ton M. Do, Riverside; Robert M. Bentley, Hacienda Heights; Gaines W. Allen, Alta Loma, all of Calif.

[73] Assignee: Hughes Aircraft Company, Los Angeles, Calif.

[21] Appl. No.: 341,725

[22] Filed: Nov. 18, 1994

[51] Int. Cl.[6] ..... H01J 29/06

[52] U.S. Cl. ..... 315/8

[58] Field of Search ..... 315/370; 4/8

[56] References Cited

U.S. PATENT DOCUMENTS

| | | | |
|---|---|---|---|
| 4,996,461 | 2/1991 | Bentley | 315/8 |
| 5,073,744 | 12/1991 | Buhler | 315/8 |
| 5,117,155 | 5/1992 | Buhler | 315/8 |

*Primary Examiner*—Robert J. Pascal
*Assistant Examiner*—Michael Shingleton
*Attorney, Agent, or Firm*—Georgann S. Grunebach; Michael W. Sales; Wanda K. Denson-Low

[57] ABSTRACT

A magnetic compensation system for a CRT display that includes a magnetic shield and a compensation coil for generating a bucking field is disclosed. The magnetic shield houses the CRT and shunts the transverse component of an external magnetic field. An annular metal face plate is attached to the shield at its open end and extends inward from the edges of the shield in a plane substantially parallel to the display. The compensation coil is disposed on the face plate's outer surface, and provides a bucking magnetic field to oppose the axial component of the external magnetic field in response to a drive signal. A pair of magnetic field sensors for sensing the difference between the external and bucking fields are spaced inward from the coil and opposite each other. The sensors are positioned substantially perpendicular to the plane of the face plate at its inner edge. A circuit senses the average of the outputs of the sensors, and adjusts the drive signal to the coil to reduce the magnitude of the average sensed field. The system also includes a magnetic field sensor outside the shield for sensing the transverse component of the external field. When either the transverse or axial components traverse predetermined triggering levels, the circuit produces a degaussing trigger signal.

30 Claims, 5 Drawing Sheets

FIG. 1.
( PRIOR ART )
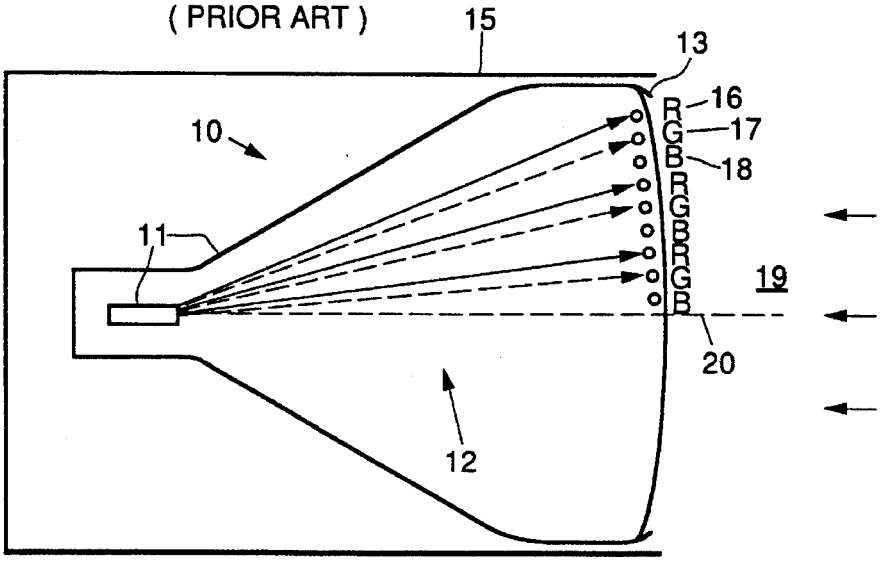
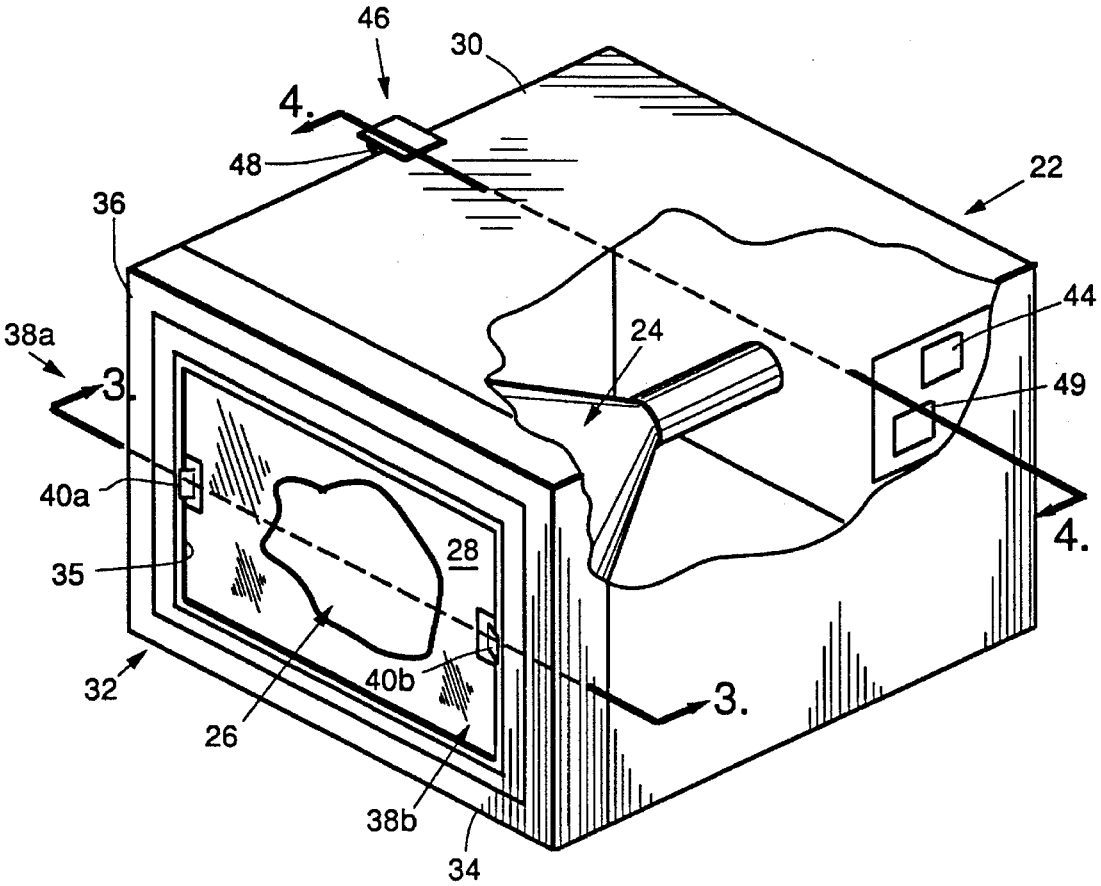
FIG. 2.

BUCKING FIELD SYSTEM AND METHOD FOR MITIGATING THE EFFECTS OF AN EXTERNAL MAGNETIC FIELD ON A CATHODE RAY TUBE DISPLAY

BACKGROUND OF THE INVENTION

1. Field of the Invention

The present invention generally relates to mitigating the effects of external magnetic fields on cathode ray tube (CRT) displays, and more specifically to a closed loop system which adjusts the drive current through a compensation coil to buck the external magnetic field.

2. Description of the Related Art

Existing CRT displays suffer intolerable display degradation in the presence of even moderate external magnetic fields e.g., greater than approximately 0.5 Gauss. The earth's magnetic field provides an ambient field which can be elevated by the presence of ferrous metals. Very high fields, of up to 5 Gauss with gradients of approximately 1 Gauss per foot, exist aboard naval ships and in industrial environments.

External magnetic shields, i.e., high permeability housings, surrounding a CRT typically provide adequate shielding against external magnetic fields up to 5 Gauss that are oriented orthogonal to the CRT viewing axis. The high permeability shield shunts most of the incident field, which prevents the field from deflecting the CRT's electron beam. For monochrome displays, external magnetic fields aligned parallel to the CRT viewing axis rotate the image about its center point, causing misregistration of the display and loss of display at the corners. Color CRT displays are even more susceptible to external fields. In addition to rotation, color displays lose color purity, beam convergence and suffer increased luminance variation.

FIG. 1 illustrates a section of a known color CRT 10 that includes an electron gun 11 for generating a beam 12 that produces a red image on a phosphor coated face plate 13. An external magnetic shield 15 is positioned around the CRT. In the baseline earth field or low level magnetic fields, the red beam is aligned to land on and excite red phosphor dots 16 to produce red images. The CRT also includes green and blue electron guns for producing beams which land on and excite green and blue phosphor dots 17 and 18, respectively.

An elevated external magnetic field 19 is shown oriented parallel to the display's viewing axis 20. In this example, the magnetic field deflects the beam so that it lands on and excites the green phosphor instead of the red phosphor. In general, the beam deflection increases as the strength of the magnetic field increases. Similar errors are induced in the green and red images such that the color and intensity of the displayed image is distorted.

It is known that the harmful effects of a slowly varying (less than approximately 2 hz) external magnetic field can be reduced by providing a bucking field in front of the CRT. Attempts to measure the external field and regulate the bucking field have been of limited success. The bucking field that opposes the external field may actually distort the CRT display.

U.S Pat. No. 4,996,461, "Closed Loop Bucking Field System" to Bentley and assigned to Hughes Aircraft Company, the assignee of the present invention, discloses a magnetic shield that is formed in the shape of the entire CRT and display screen. A compensation coil is disposed around the outside of the shield at its open end on a plane parallel to the display screen. The compensation coil produces a bucking field, in response to a dc current, that opposes the external field. Four magnetic field sensors are positioned adjacent to the inner surface of the magnetic shield at the back of the CRT. The positions of the sensors makes them responsive only to the portion of the external magnetic field that enters the shield, and insensitive to the bucking field. The sensors must be very sensitive to detect the relatively weak fields that penetrate the shield, and hence are expensive. A circuit adjusts the dc current to the coil in response to the external field strength sensed by the four sensors. This system must be calibrated in a known external field.

U.S. Pat. No. 5,073,744, "Method and Apparatus For Dynamic Magnetic Field Neutralization" to Bubler, discloses four different and nonplanar coils positioned around the open end of a magnetic shield for producing bucking fields in opposition to the external field. Each coil has portions parallel to each of the axial, horizontal and vertical fields, and is in electrical communication with an expensive and complex fluxgate sensor. Four sensors are placed as close to the CRT display screen as possible in respective corners of the screen. The control circuitry adjusts the drive currents in the respective coils such that the resultant field at each sensor is reduced. The system requires calibration in a known field.

The currently available systems utilize complex and expensive sensors to detect the external fields, and require calibration in a known external field. A simple and inexpensive system that accurately senses and substantially opposes the external fields so that the display is not distorted is needed. The system should not require calibration, and should be able to use relatively insensitive, and thus inexpensive, magnetic field sensors. The shielding system should also be capable of automatically degaussing the display from the sensed field components.

SUMMARY OF THE INVENTION

The present invention provides a simple and relatively inexpensive system for mitigating the effects of external magnetic fields on CRT displays.

This is accomplished with a magnetic shield for housing a monitor, and a closed loop system for providing a bucking field. The shield shunts the transverse components of the external field, while the bucking field substantially cancels the axial component. An annular metal face plate is attached to the shield at its open end, and extends inward from the edges of the shield in a plane substantially parallel to the display. A compensation coil is positioned on the face plate's outer surface and, in response to a drive current produces the bucking magnetic field to oppose the external magnetic field. A pair of magnetic field sensors for sensing a differential field are spaced inward from the coil and opposite each other. The differential field is the difference between the external and bucking fields. The sensors are positioned substantially perpendicular to the plane of the face plate at its inner edge. A magnetic compensation circuit averages the outputs of the sensors, and adjusts the drive current to the coil to reduce the magnitude of the differential field.

The system also includes a magnetic field sensor outside the shield for sensing the transverse components of the external field. When either the transverse or axial components cross predetermined trigger levels, the circuit produces a degauss trigger signal.

For a better understanding of the invention, and to show how the same may be carried into effect, reference will now be made, by way of example, to the accompanying drawings.

BRIEF DESCRIPTION OF THE DRAWINGS

FIG. 1 is a diagram, described above, of a CRT projecting a red beam onto its phosphor face plate in the presence of a magnetic field;

FIG. 2 is a perspective view of a partially cut away CRT display and magnetic compensation system in accordance with the invention;

DETAILED DESCRIPTION OF THE INVENTION

Figure 3:
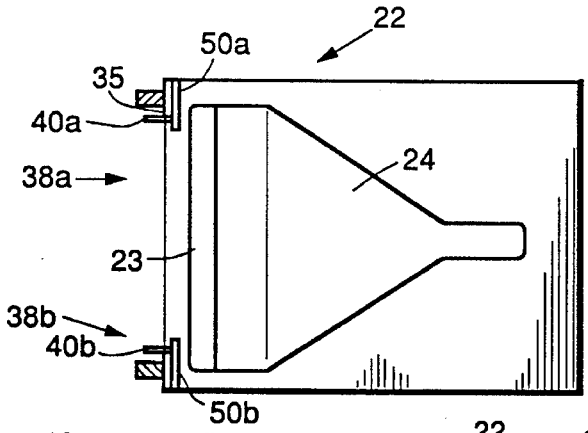
FIG. 3 is a sectional view along cut line 3—3 of FIG. 2 illustrating the positioning of the axial sensors.

Referring first to FIG. 2, a magnetic compensation system 22 is shown. A color CRT 24 includes RGB electron guns (not shown) which produce respective RGB beams to form a color display 26 on its phosphor face plate 28. The invention is applicable to a monochrome display as well.

The CRT is housed in a magnetic shield 30. The shield preferably has a rectangular shape with an open end 32 for viewing the display. This shape allows the shield to be used with a wide variety of monitor shapes and sizes. Alternatively, the shield could be formed to the shape of the CRT. The shield is constructed of a high permeability material, i.e. MU metal, such as AD-MU-80 produced by ADVANCE MAGNETICS, INC. This Nickel-Iron alloy (MU metal) prevents the external transverse magnetic field from penetrating the shield and deflecting the CRT electron beam.

An annular face plate 34 of similarly high permeability material is formed around the circumference of the shield at its open end 32. The face plate extends inward from the edge of the shield by approximately 5–8 cm to an interior edge 35 and lies in a plane parallel to the plane of the phosphor face plate 28. The face plate is attached to the shield, either as an integral part of the shield 30 or as a separate attached piece.

A compensation coil 36 is positioned on the outer surface of the face plate 34 at the shield's open end. The compensation coil might typically have 120 turns of #20 AWG wire. A current in the compensation coil produces a bucking field in opposition to the external magnetic field. The bucking field cancels the external field in front of the CRT, and thus maintains the integrity of the display.

Figure 5A:
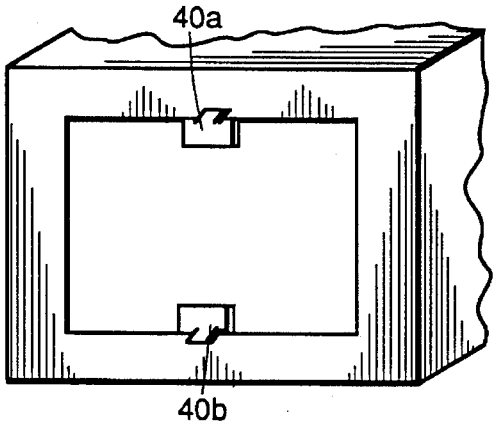
FIGS. 5*a* and 5*b* show alternative placements of the magnetic field sensors.
Figure 5B:
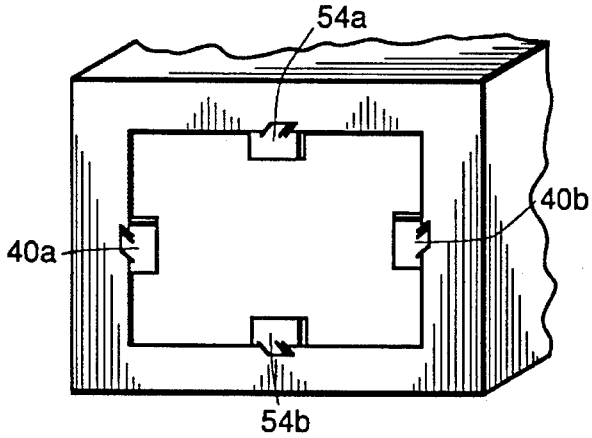

A pair of modules 38*a* and 38*b* having respective magnetic sensors 40*a* and 40*b* are affixed to the face plate 34 so that the sensors are spaced inward from the coil and adjacent opposite edges 35 of the face plate. The sensors are preferably oriented orthogonal to the plane of the face plate 34. The external field lines are attracted towards the edge of the face plate such that the magnetic field density (flux) is greatly increased at the edge of the face plate. Placing the sensors perpendicular to the field lines at the edge of the face plate improves the sensors ability to measure the external magnetic field and allows for the use of less costly sensors. Alternative sensor positions are shown in FIGS. 5*a*–5*b*.

The sensors 40*a* and 40*b* detect differential field values that are equal to the difference between the external and bucking fields at their respective positions. This operation is described in greater detail below in connection with FIG. 6. For a given shield and face plate configuration, the coil-to-sensor spacing is determined by independently monitoring the differential field, and adjusting the spacing until the sensors' outputs are equal to a known reference value when the differential field in front of the CRT is zero. Determining the proper spacing is part of the design, and is not changed thereafter.

By using a pair of symmetrically positioned sensors the system can compensate for spatial variations in the external field. These variations can be caused by either a gradient in the external field, or by a non-parallel orientation of a uniform external field. With a uniform field that is parallel to the display's viewing axis the sensors will detect the same field strength, so that the bucking field is approximately equal and opposite to the external field. With a gradient or non-parallel field, on the other hand, the sensors will detect different field strengths and the amount of current supplied to the compensation coil will be proportional to the average of the sensed values integrated over time.

A closed loop negative feedback circuit 44 (see FIG. 7 for details) receives as inputs the voltage signals generated by the differential fields from sensors 40*a* and 40*b*, amplifies the signals, integrates the average of the signals and adjusts the current to the coil accordingly to reduce the magnitude of the average differential fields. If the axial component of the external field is larger than the bucking field the circuit increases the current. Conversely, if the axial component of the external field is smaller than the bucking field the circuit reduces the current.

When a transient occurs in the external field the CRT can become magnetized and require degaussing to demagnetize it. Another module 46 having a magnetic sensor 48 is disposed outside the shield to sense the transverse components of the external magnetic field. The sensor detects both the x-axis component which is perpendicular to the sensor and the y-axis component which is bent towards the side of the shield. A circuit 49 monitors the current to the coil, which is proportional to the bucking field, and the transverse components of the external magnetic field. When either the transverse components or the coil current passes through one of several different predetermined trigger levels, in either a positive or negative direction, the circuit 49 produces a degaussing trigger signal. The trigger signal activates a degaussing circuit which degausses the CRT. The circuit 49 incorporates some measure of hysteresis so that small variations in the field strength do not produce false or multiple trigger signals. Furthermore there is a minimum reset period between trigger signals to allow recharging the degaussing circuit.

FIG. 3 is a sectional view of the CRT display and compensation system 22 shown in FIG. 2. The sensor modules 38*a* and 38*b* comprise circuit boards 50*a* and 50*b*, respectively, for holding the sensors 40*a* and 40*b*. The circuit boards are mounted on the back side of the face plate 34, and include a portion of circuit 44 (not shown). The sensors are preferably positioned so that they are in contact with and perpendicular to the inner edge 35 of the face plate in order to take advantage of the increased flux density of the external field. In some applications, such as when the shield and face plate experience significant vibration, it may be desirable to mount the module on a non-magnetic metal bracket to reduce stress on the sensor. The sensor-to-coil spacing is in a range of approximately 2.5 to 4 cm.

Figure 4:
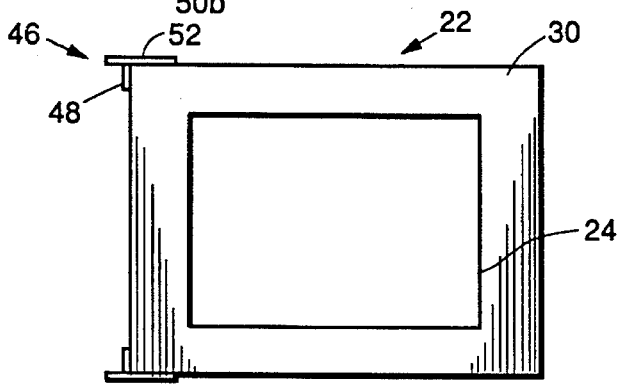
FIG. 4 is a sectional view along cut line 4—4 of FIG. 2 illustrating the positioning of the transverse sensor.

FIG. 4 is a sectional view of the CRT display and compensation system 22 shown in FIG. 2 illustrating the positioning of the transverse sensor 48. The sensor module 46 includes a circuit board 52 for holding the sensor adjacent to one side of the shield 30 so that it can sense the transverse (x-,y-axis) components of the external field.

FIGS. 5*a* and 5*b* show examples of alternative placements of the axial magnetic field sensors. In FIG. 5*a* the sensors 40*a* and 40*b* are centrally located along the face plate's top and bottom inner edges, respectively. In FIG. 5*b* two pair of sensors 40*a*, 40*b* and 54*a*, 54*b* are disposed at central positions along the left, right, top and bottom edges of the face plate, respectively. In this case, the feedback circuit would respond to the average of the difference field at the four sensor locations. Several different sensor placement configurations can be envisioned without departing from the scope of the invention. The coil-to-sensor spacing must be adjusted in accordance with the specific configuration.

Figure 6:
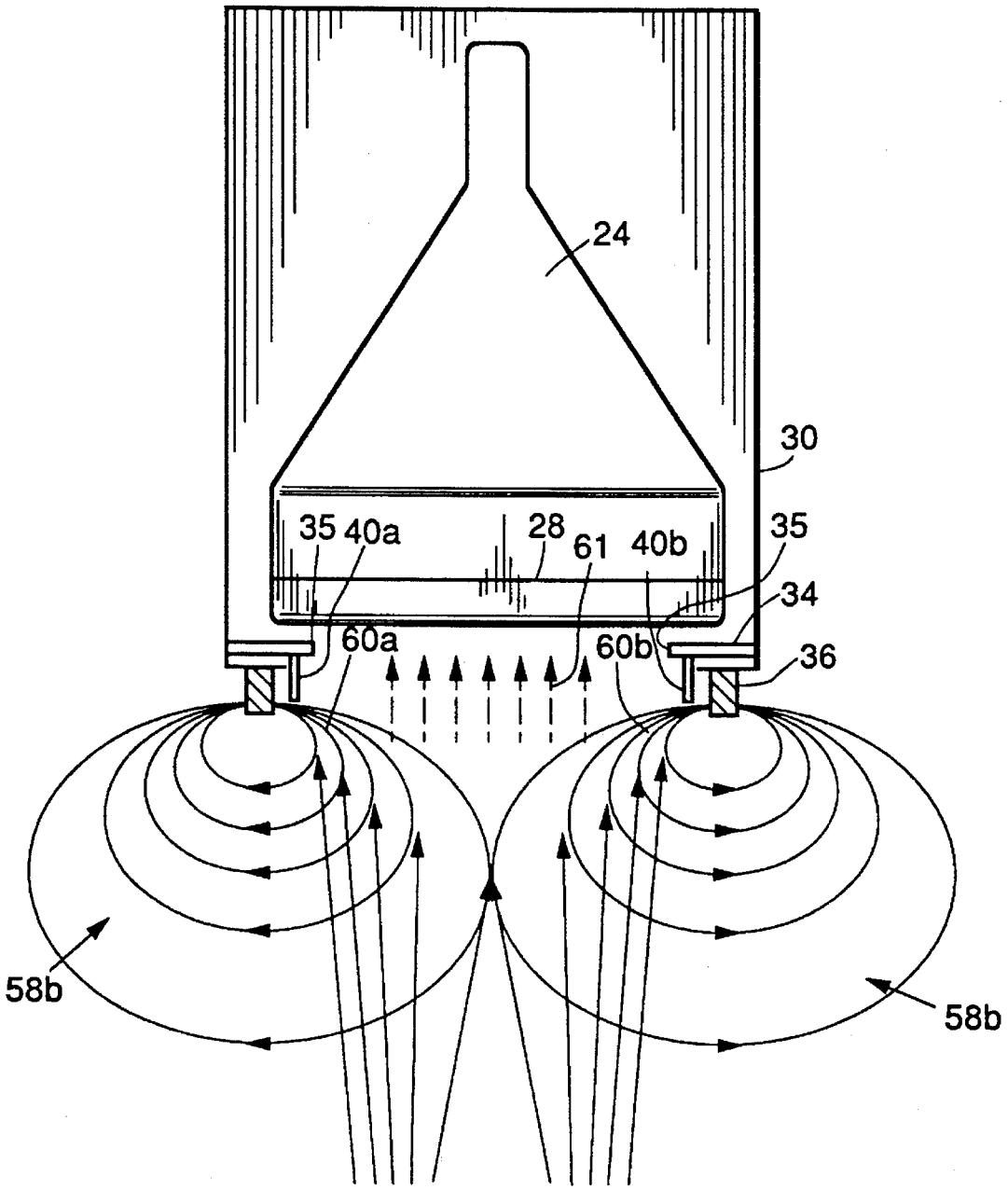
FIG. 6 is a diagram of the external magnetic field lines and the bucking field lines.

FIG. 6 is a diagram of the field lines for a uniform axial external magnetic field 56 ($B_{EXT}$), and the bucking field lines 58*a* and 58*b* ($B_{BUCK}$) provided by the system shown in FIG. 2. The external field lines are attracted towards and concentrated at the edge 35 of the high permeability face plate 34, so that the external field strength at the edge is several times greater than its strength at the center of the display. The current flowing through the compensation coil 36 produces the bucking field lines 58*a* and 58*b* that oppose the external field lines. The bucking field strength close to the coil is several times greater than its strength at the center of the display. The compensation coil and coil-to-sensor spacing, are designed by trial and error until the profile of the external field strength in front of the CRT approximately matches that of the bucking field. Therefore adjusting the bucking field to reduce the differential fields 60*a* and 60*b* at the sensors effectively reduces the differential field 61 across the front of the CRT 28.

The face plate 34 serves two very important functions. First, it concentrates the external field lines at its interior edge 35. For example, if the external field has a strength of 5 Gauss, it might appear to be 25 Gauss at the sensor. As a result less sensitive and lower cost Linear Hall effect sensors can be used. These sensors have the additional benefit of not becoming magnetized. More sensitive sensors will become magnetized and must occasionally be degaussed. Secondly, the face plate modifies the strength profile of the external field in front of the CRT so that it closely matches the profile associated with the compensation coil. This facilitates a more effective and uniform cancellation of the external field across the entire viewing area of the display.

Figure 7:
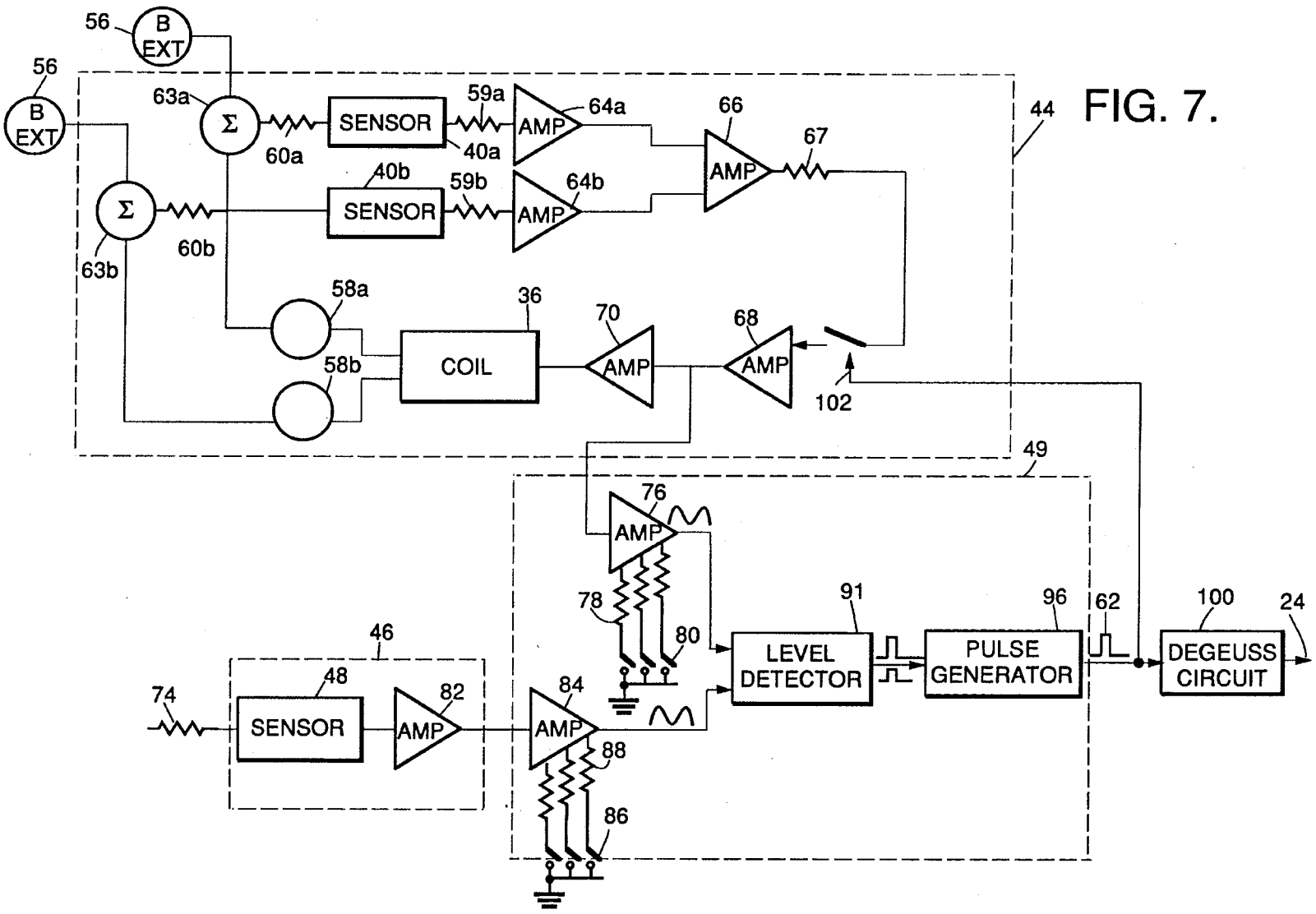
FIG. 7 is a block diagram of a closed loop compensation circuit for adjusting the bucking field and triggering the degaussing circuit.

FIG. 7 is a block diagram of a closed loop compensation circuit 44 that can be used to adjust the bucking fields 58*a* and 58*b*, and a circuit 49 for producing a degaussing trigger signal 62. Each sensor 40*a* and 40*b* senses the difference between the external field 56 and the bucking fields 58*a*, 58*b* at their respective positions, and provides as an output a signal 59*a* and 59*b* that varies with the differential fields 60*a* and 60*0*. Summing nodes 63*a*, 63*b* are used to indicate the formation of the differential fields 60*a*, 60*b* from the external field 56 and bucking fields 58*a* and 58*b*. The sensors' output voltages 59*a*, 59*b* are amplified by amplifiers 64*a* and 64*b*, and provided as inputs to a summing amplifier 66.

Figure 8:
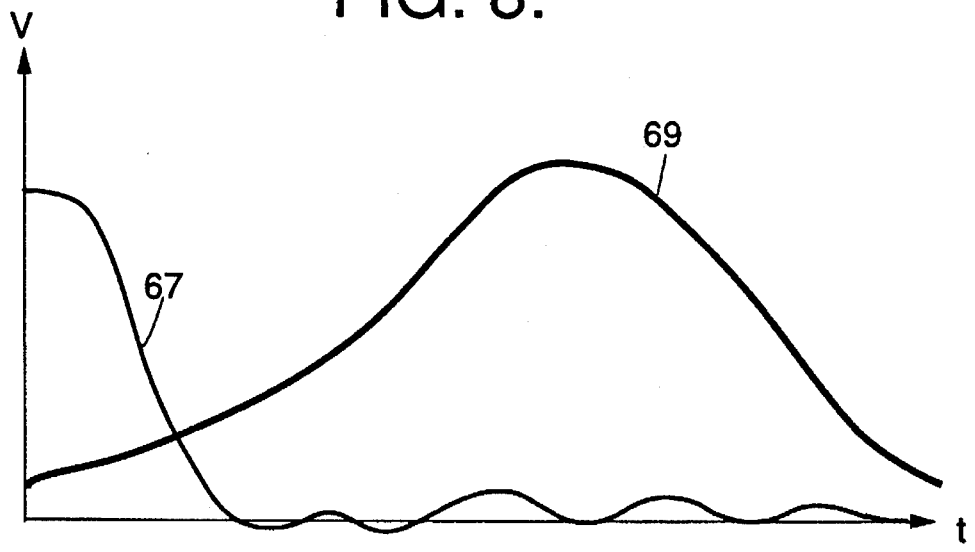
FIG. 8 is a plot of the average differential field and the integrated voltage for driving the compensation coil.

The output signal 67 of the summing amplifier represents the average of differential fields 60*a* and 60*b* sensed by the pair of sensors. The output signal 67 is provided as an input to an integrating amplifier 68 which integrates it to produce an integrated voltage 69. A voltage-to-current amplifier 70 converts the integrated voltage signal 69 into a low frequency current 72, typically between DC and 2 hz, for driving the compensation coil 36. The output signal 67 and integrated voltage 69 are plotted in FIG. 8. When the external field 56 is greater than the bucking fields 58*a* and 58*b*, the integrated error signal is increased, which in turn increases the current through the coil 36 to increase the bucking fields 58*a* and 58*b*.

The CRT can become magnetized when the external field experiences a transient signal. Changes in the external field of greater than 1 Gauss can magnetize the CRT. Trigger levels for the transverse and axial fields are selected such that when the fields pass through one of the trigger levels the system is degaussed. The spacing of the trigger levels corresponds to a change in field strength that is sufficient to cause beam landing errors, and thus color distortion of the display.

The circuit 49 produces a degaussing trigger signal 62 in response to both the magnitude of the bucking fields 58*a* and 58*b*, and the magnitude of the transverse components 74 of the external magnetic field 56. The magnitude of the bucking field in the form of the integrated voltage 69 is provided as the input to a variable gain amplifier 76 in the degauss trigger circuit 49. The gain of amplifier 76 is controlled by a resistor network 78, and is set by changing the position of user programmable switches 80. The output of external sensor 48 is proportional to the transverse components 74 of the external field, and is provided as the input to an amplifier 82. The amplifier's output is connected to a variable gain amplifier 84, whose gain is set by user programmable switches 86 connected through a resistor network 88. The variable gain amplifiers 76 and 84 allow the system to be used with different CRTs and compensation systems.

The outputs 89 and 90 of amplifiers 76 and 84, respectively, are provided as inputs to a level detection circuit 91. This circuit compares the amplifier outputs 89 and 90, which respectively represent the bucking and transverse external field strengths, to the sets of trigger voltages, respectively. When either amplifier output passes through one of its predetermined voltages in either a positive or a negative direction, the level detection circuit outputs a degauss trigger signal 95.

A pulse generator 96 receives as inputs the output 95 of the level detector 91 and a reset signal 98. The reset signal inhibits the pulse generator from producing subsequent trigger signals 62 until a degaussing circuit 100 has had enough time to recharge. The circuit may recover virtually instantaneously or may take a few, e.g. 4, seconds to recover. After the degaussing circuit has recovered, the next positive signal from the level detector causes the pulse generator to output a pulse to the degaussing circuit, causing it to degauss the CRT 24. The pulse 62 also temporarily opens a switch 102 between the summing and integrating amplifiers 66 and 68 so that degaussing does not effect the bucking field. The level detection circuit avoids unnecessary degaussing by incorporating an amount of hysteresis so that small variations or oscillations in the external field do not produce unwanted trigger pulses.

Figure 9:
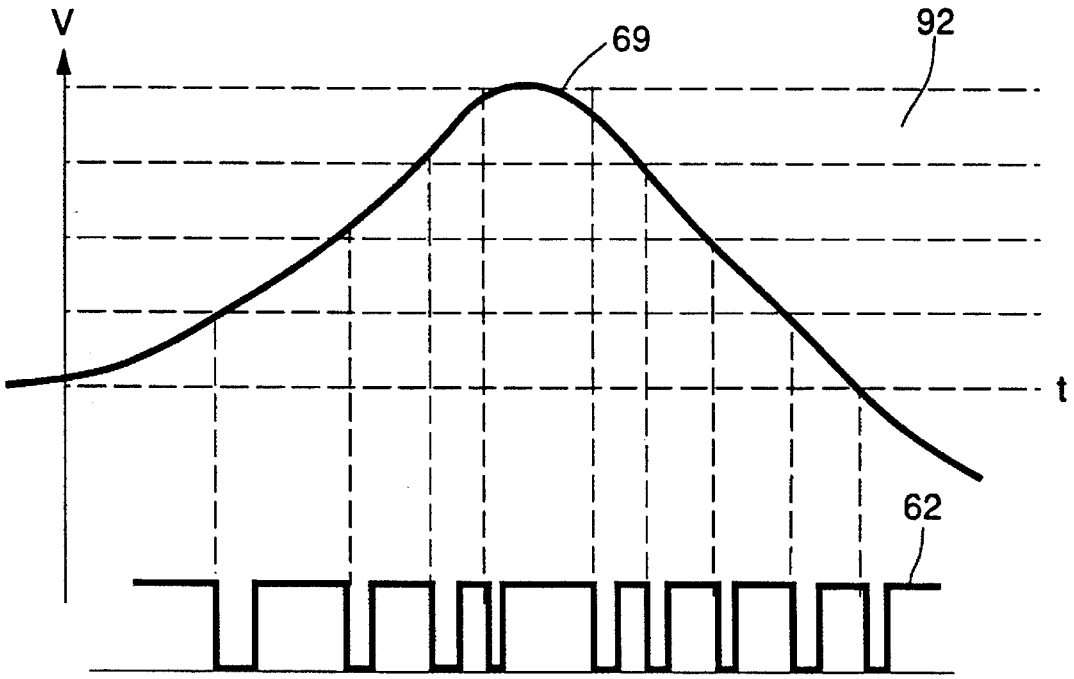
FIG. 9 is a diagram of the bucking field strength and the degauss triggering pulses.

FIG. 9 is a plot of the integrated voltage 69 which represents the magnitude of the external axial magnetic field and the degaussing triggering signals (pulses) 62. When the integrated voltage 69 crosses the predetermined axial trigger levels 92, the level detection circuit instructs the pulse generator to emit a short pulse.

While several illustrative embodiments of the invention have been shown and described, numerous variations and alternate embodiment will occur to those skilled in the art. Such variations and alternate embodiments are contemplated, and can be made without departing from the spirit and scope of the invention as defined in the appended claims.

We claim:

1. A system for mitigating the effects of an external magnetic field on a cathode ray tube (CRT), comprising:

a metal shield having an open end for housing said CRT;

an annular metal face plate that is attached to said shield at its open end;

a coil that is disposed on said face plate and around said shield's open end, said coil responding to a drive signal to produce a bucking magnetic field in opposition to said external magnetic field;

a first magnetic field sensor that is disposed inward from said coil for sensing a differential field between said external and said bucking magnetic fields; and a circuit for adjusting said drive signal in response to said sensed differential field to reduce the magnitude of said differential field.

2. The system of claim 1, wherein said face plate extends inward from said shield such that said external magnetic field is concentrated along an interior edge of said face plate, and said coil is disposed on an outer surface of said face plate.

3. The system of claim 2, wherein said magnetic field sensor is positioned substantially perpendicular to and in contact with said face plate's interior edge.

4. The system of claim 2, wherein said magnetic field sensor is a linear Hall effect sensor.

5. The system of claim 1, further comprising a second magnetic field sensor disposed inward from said coil and opposite said first magnetic field sensor for sensing a differential field between said external and said bucking magnetic fields at its location.

6. The system of claim 5, wherein said circuit averages the differential fields sensed by said magnetic field sensors and adjusts said drive signal to reduce the magnitude of said average.

7. The system of claim 6, wherein said circuit integrates the average signal to adjust said drive signal.

8. The system of claim 1, wherein said shield is a rectangular shield with five closed sides and open side for accessing a CRT display screen.

9. The system of claim 1, wherein said circuit produces a degaussing trigger signal when said drive signal traverses one of a predetermined set of signal levels.

10. A system for mitigating the effects of an external magnetic field on a cathode ray tube (CRT), comprising:

a magnetic shield having an open end for housing said CRT;

a metal face plate that is formed along the circumference of said shield's open end;

a coil that is disposed on said face plate and around said shield's open end for providing a bucking magnetic field in response to a drive signal to oppose said external magnetic field;

a magnetic field sensor that is disposed inward from said coil for sensing a differential field between said external and said bucking magnetic fields;

a transverse magnetic field sensor that is positioned outside said shield for sensing a transverse component of said external field; and a circuit for adjusting said drive signal in response to said sensed differential field such that said bucking field opposes said external field to reduce the magnitude of said differential field, and for producing a degaussing trigger signal when said transverse magnetic field component passes through a predetermined value.

11. The system of claim 10, wherein said circuit produces said degaussing trigger signal when said drive signal passes through a predetermined value.

12. The system of claim 11, wherein said circuit incorporates a predetermined amount of hysteresis.

13. The system of claim 11, wherein said circuit has a delay between successive trigger signals.

14. A system for mitigating the effects of an external magnetic field on a color cathode ray tube (CRT), comprising:

a five sided rectangular shaped magnetic shield having an open end for housing said CRT;

an annular metal face plate that is attached to said shield at its open end, said face plate being substantially perpendicular to the sides of said shield and extending inward therefrom;

a coil that is disposed circumferentially on the outside of said face plate, said coil responding to a drive signal to produce a bucking magnetic field in opposition to said external magnetic field;

a pair of linear Hall effect sensors that are disposed substantially perpendicular to said face plate and positioned opposite each other inside said coil for sensing differential fields between said external and said bucking magnetic fields; and a circuit for adjusting said drive signal in response to an average of said differential fields such that said bucking field opposes said external field to reduce the magnitude of said average.

15. A system for mitigating the effects of an external magnetic field on an image display, comprising:

a CRT having a phosphor face plate, said CRT writing images onto the face plate which in turn displays the images;

a magnetic shield having an open end for housing said CRT and said shadow mask;

a metal face plate is attached to said shield at its open end such that it is substantially parallel to said face plate;

a coil that is circumferentially disposed on said face plate for providing a bucking magnetic field to oppose said external magnetic field in response to a drive signal;

a first magnetic field sensor that is disposed inward from said coil and substantially perpendicular to said face plate for sensing a differential field between said external and said bucking magnetic fields; and a circuit for adjusting said drive signal in response to said sensed differential field to reduce the magnitude of said differential field.

16. The system of claim 15, wherein said face plate extends inward from the shield such that said external magnetic field is concentrated along an interior edge of said face plate, and said coil is disposed on an outer surface of said face plate.

17. The system of claim 16, wherein said magnetic field sensor contracts said face plate's interior edge.

18. The system of claim 16, wherein said magnetic sensor is a linear Hall effect device.

19. The system of claim 15, further comprising a second magnetic field sensor that is disposed inward from said coil and opposite said first magnetic field sensor.

20. The system of claim 15, wherein said circuit averages the sensed differential fields and adjusts said drive signal to reduce the magnitude of said average.

21. The system of claim 20, wherein said circuit integrates the average signal to adjust said drive signal.

22. The system of claim 15, wherein said shield is a five-sided rectangular shield.

23. The system of claim 15, wherein said circuit produces a degaussing trigger signal when said drive signal traverses one of a predetermined set of levels.

24. A system for mitigating the effects of an external magnetic field on a cathode ray tube (CRT), comprising:

a magnetic shield having an open end for housing said CRT;

a coil that is disposed circumferentially around said shield's open end, said coil responding to a drive signal to produce a bucking magnetic field in opposition to said external magnetic field, said bucking field having a non-uniform profile;

a first magnetic field sensor that is disposed inward from said coil for sensing a differential field between said external and said bucking magnetic fields;

a field concentrator for modifying the external field's profile to approximately match the bucking field's non-uniform profile; and a circuit for adjusting said drive signal in response to said sensed differential field to reduce the magnitude of said differential field.

25. The system of claim 24, wherein said field concentrator concentrates the external field at said sensor.

26. The system of claim 25, wherein said field concentrator is an annular metal face plate that is attached to said shield at its open end and extends inward from said shield such that said external magnetic field is concentrated along an interior edge of said face plate.

27. The system of claim 26, wherein said coil is disposed on an outer surface of said face plate so that said bucking field is shielded from the interior of said shield.

28. A method for mitigating the effects of an external magnetic field on a cathode ray tube (CRT), comprising:

generating a bucking field having a known profile to oppose the external magnetic field;

modifying the external magnetic field's profile to approximate the bucking field's profile;

sensing a differential field between the external and bucking magnetic fields; and adjusting the bucking field in response to the sensed differential field to reduce the magnitude of the differential field.

29. The method of claim 28, further comprising concentrating the external field to improve said sensing of said differential field.

30. The method of claim 28, further comprising producing a degaussing trigger signal when said external field traverses one of a predetermined set of triggering levels.

* * * * *